United States Patent [19]

Zucchini

[11] 4,091,643

[45] May 30, 1978

[54] CIRCUIT FOR THE RECOVERY OF SOLVENT VAPOR EVOLVED IN THE COURSE OF A CLEANING CYCLE IN DRY-CLEANING MACHINES OR PLANTS, AND FOR THE DE-PRESSURIZING OF SUCH MACHINES

[75] Inventor: Guido Zucchini, Castelmaggiore (Bologna), Italy

[73] Assignee: AMA Universal S.p.A., Bologna, Italy

[21] Appl. No.: 769,849

[22] Filed: Feb. 17, 1977

[30] Foreign Application Priority Data

May 14, 1976 Italy ..... 3429 A/76
Nov. 2, 1976 Italy ..... 3575 A/76

[51] Int. Cl.[2] ..... D06F 43/08
[52] U.S. Cl. ..... 68/18 C; 68/18 F
[58] Field of Search ..... 68/18 F, 18 R, 18 C; 34/82; 55/74, 387

[56] References Cited

U.S. PATENT DOCUMENTS

| | | | |
|---|---|---|---|
| 2,526,782 | 10/1950 | Thorpe | 55/387 X |
| 2,656,696 | 10/1953 | McDonald | 68/18 R |
| 3,692,467 | 9/1972 | Durr et al. | 68/18 F X |
| 3,978,694 | 9/1976 | Hughes et al. | 68/18 R |

*Primary Examiner*—Philip R. Coe
*Attorney, Agent, or Firm*—Browdy and Neimark

[57] ABSTRACT

Recovery of solvent vapor in the course of the cleaning cycle in dry-cleaning machines and/or plants, which include a cleaning circuit, a drying circuit and a distillation circuit, in which low boiling-point solvents are utilized in particular, and simultaneous de-pressurization of such machines, inside of which, in the course of said dry-cleaning operation, a partial evaporation of the solvent occurs which results in the building-up of a given pressure, are accomplished by means of a filter, which whose inlet is directly connected with any point of the drying circuit, while its outlet is directly connected with the outside.

5 Claims, 2 Drawing Figures

Figure 1:
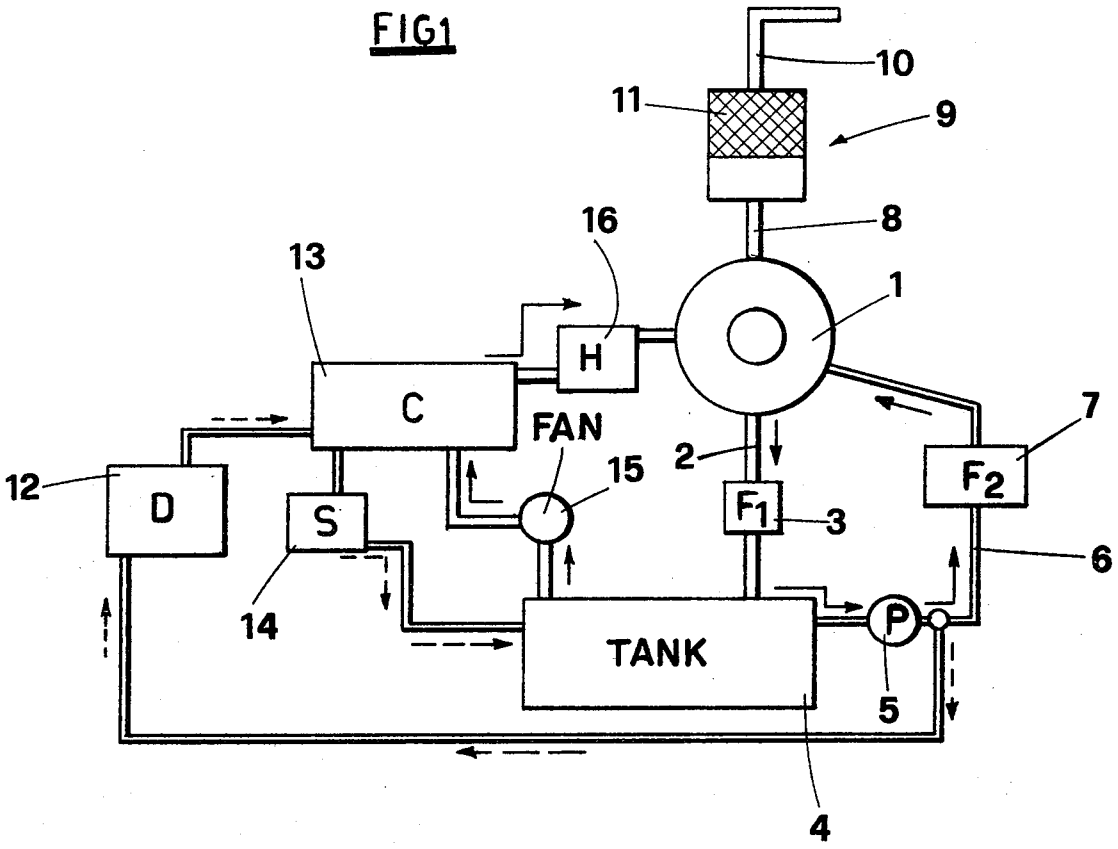

CIRCUIT FOR THE RECOVERY OF SOLVENT VAPOR EVOLVED IN THE COURSE OF A CLEANING CYCLE IN DRY-CLEANING MACHINES OR PLANTS, AND FOR THE DE-PRESSURIZING OF SUCH MACHINES

The present invention concerns a circuit for the recovery of solvent vapor evolved in the course of the cleaning cycle in dry-cleaning mechines and/or plants, and for the de-pressurizing of such machines, in particular for dry-cleaning machines wherein use is made of low boiling point solvents.

A part of the solvent is vaporized, due to different reasons in the course of the cleaning cycle in such machines, which results in a given overpressure, and unacceptable values may be attained by such overpressure inside of the cleaning drum, and in particular inside of the whole plant.

Therefore, recourse has been made, in different prior art designs, to breather orifices, directly connected with the cleaning drum, or with another section of the plant directly connected therewith, through which the gradually evolved vapor are discharged from the drum, leaving nearly unchanged the pressure values inside of the machine. However, it is then essential to prevent the air-vapor mixture, outflowing from the cleaning drum, from being discharged directly into the ambient air, without a previous purification, in order to prevent noxious pollutions, and to reduce costly solvent losses.

For such a purpose, prior art circuits and devices have been devised for the purification of air and the simultaneous recovery of solvent present in the outflow from the cleaning drum. However, such devices, while allowing for a very good solution of the problem, require the use of specific equipments, and the realization of complex supplemental circuits, in addition to those already present in the considered machines, whereby the prime costs are unduly increased, and the purification times are materially lengthened.

In an already known solution, use is made of a filter (usually with an activated carbon cartridge), through which the stream of air-solvent vapor mixture, outflowing from the cleaning drum, is passed. The solvent is adsorbed on the activated carbon, while the purified air is discharged into the room.

For the recovery of solvent retained in said filter, at the end of each dry-cleaning cycle, steam — preferably coming from the plant distiller — is led through the same filter, thereby causing the evaporation of solvent therefrom. The steam saturated with solvent is then led to the plant condenser, where the solvent is wholly recovered.

Obviously, by the above solution, the installation of particular devices and equipment is required, which results in relatively high installation and operating costs.

The main purpose of the present invention is the prevention of drawbacks as stated above, through the realization of a circuit for the recovery of solvent from the vapors evolved in the course of a cleaning cycle in dry-cleaning machines and/or plants, and for the depressurizing of such machines, performing such recovery by unusually simple and efficient equipment, requiring remarkably reduced installation costs, and operating costs practically reduced to zero, taking advantage of features typically pertaining to such machines.

A further purpose of the present invention consists in keeping, throughout the whole cleaning cycle and the subsequent drying cycle, in the course of which the recovery of solvent is performed, the pressure inside of the plant always equal to atmospheric pressure.

The above and further purposes are attained by the circuit according to the present invention, for the recovery of solvent from the vapors evolved in the course of the operation of dry-cleaning machines and/or plants, and for the de-pressurizing of such machines. The dry-cleaning machine and/or plants include a dry-cleaning circuit, a drying and solvent recovery circuit and a distillation circuit. The dry-cleaning circuit comprises, in series, a cleaning drum, a solvent tank, a solvent circulating pump and a filter for the solvent. The drying and solvent recovery circuit comprises, series-connected with said drum, a fan for the circulation of vapors, and a condensing-separating-heating assembly, connected at the end of said circuit. The distillation circuit comprises a distiller, connected with said solvent tank and with said condenser, and by which the solvent is purified in a continuous or discontinous cycle. The improvement of the present invention is characterized in that it comprises a filter for the recovery of solvent, located at a level higher than that of the whole plant, and which inlet is directly connected with the highest point of the drying circuit, while its outlet leads to the atmosphere.

The further features and advantages of the present invention will be better appreciated from a consideration of the following detailed description of two preferred, but not exclusive embodiment forms thereof, as shown in the accompanying drawings, both description and drawings being given as a non-restrictive example only. In the drawings:

FIG. 1 diagrammatically shows a first embodiment form of the circuit according to the present invention, as fitted in a machine for the cleaning and drying of clothing.

Figure 2:
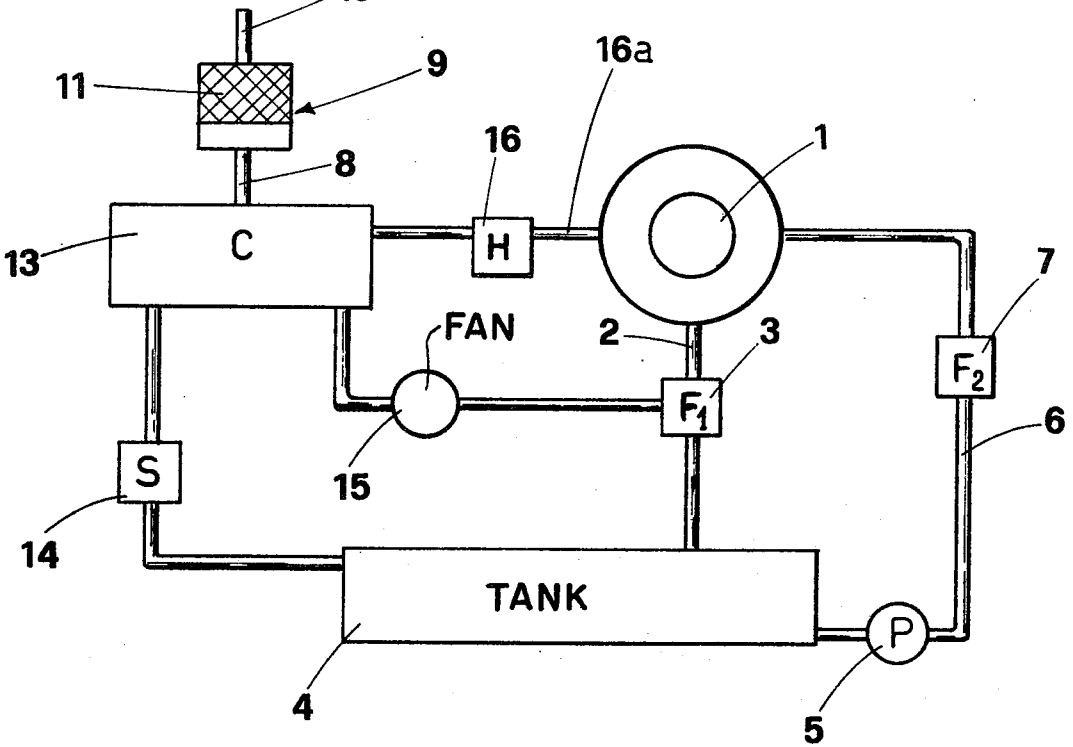

FIG. 2 diagrammatically shows a second embodiment form of the circuit, also fitted in a similar machine.

Referring now to FIG. 1, dry-cleaning drum 1 is connected by a long pipe 2, in which a pin trap filter 3 is inserted, with a solvent tank 4; pump 5 has its suction side is connected with said tank, while the delivery side is connected by a pipe 6, fitted with a filter 7, with said drum 1.

Connected by a pipe 8 in the considered case to said drum, but more generally to any other point of the plant, is a filter 9, where the outlet is in turn connected, by a pipe 10 with the outside. Filter 9 of which is located at a level higher than that of the whole plant, and in particular at the highest point of the drying circuit. A proper filter cartridge 11 (preferably filled with activated charcoal), take up the upper portion only of the inside space of the filter casing.

Referring again to FIG. 1, a distiller 12 of known type, is provided wherein the solvent, flowing from the tank 4 is wholly vaporized. The vaporized solvent flows to a condenser 13, wherein it is converted into its liquid state again, deprived from the impurities not vaporized in the preceding distillation step.

Then the solvent flows from the condenser to a separator 14, wherein all other impurities (water and the like), not removed by the distillation, are taken-off, and finally it is returned to its tank 4. Connected with said tank, in the top of which a filtering element is fitted, is the suction side of a fan 15, whose delivery side is connected with said condenser 13, the condenser outlet being connected with a heater 16 of known type, which is finally in communication with the drum 1.

In the course of the dry-cleaning step, the solvent is continuously taken, by the pump 5, out of its tank and delivered to the drum, wherefrom it is returned to tank 4 through the piping 2. In said step, no delivery from the pump to the distiller occurs (it is assumed, namely, that a discontinuous distillation machine is utilized).

The gas (i.e. a mixture of air and solvent vapor) evolved inside of drum 1 is; led through the pipe 8, to filter 9, wherein the most part of the solvent is separated by gravity, and is collected onto the bottom thereof, while the remaining part is adsorbed on the activated charcoal; the thus purified air is discharged to the outside through the pipe 10, thus preventing that a pressure may be built-up in the plant inside.

At the end of the dry-cleaing step, the processed clothing is dried; the air-solvent vapor mixture, sucked by the fan 15 from the drum 1, is led by the pipe 2, into the top of tank 4, inside of which a first separation occurs of that portion of solvent condensed while running through said pipe, or — as disclosed also in the second solution — said mixture is directly sucked from the drum 1 through the filter 3, by passing tank 4.

Then the same mixture is delivered to the inside of condenser 13, where the recovery of solvent is carried-out; the condensate is collected within the separator 14, whose task is to remove from the solvent those impurities (water, etc.) that are unavoidably admixed therewith in the course of condensation, whereupon the purified solvent is returned to its tank 4. The air discharged from the condenser 13 is heated in the heater 16 and then delivered to the dry-cleaning drum whereby the start of the next cleaning cycle is ready to begin; it is important to remark that in the course of such drying step, owing to condensation, a slight depression occurs in the related circuit, whereby the solvent collected on the bottom of filter 9 in the course of the preceding dry-cleaning step is caused to flow into the drum 1, being thus recovered; moreover, due to the action of the air stream flowing from the pipe 10, the portion of solvent present in the filter cartridge is also recovered (due to its low boiling point) whereby the filter is maintained always in its active condition.

As previously stated, the purification of solvent may be made also discontinuously; by reversing the pump 5, the solvent to be purified is delivered to distiller 12, wherein it is evaporated, and then it is led to condenser 13, to separator 14 and back to tank 4.

Obviously, in the above embodiment form of plant, the solvent, which in the drying step is collected in the filter 9 and adsorbed on the activated charcoal, is not wholly recovered whereby at the end of a daily work, or better stated after a given number of dry-cleaning and drying steps of machine, the filter unit 11 will be clogged with solvent, with consequent necessity to replace it.

Such necessity is safely prevented in the second embodiment form (see FIG. 2), wherein the inlet of the recovery filter 9 is directly connected by pipe 8 with the condenser 13 while the outlet of the same filter is directly connected by the pipe 10 with the outside. It is essential that in the circuit as shown in the FIG. 2, no cutoff valve be interposed between the condenser 13 and the drum 1, which will be explained in more detail later on.

The operation of the circuit as shown in the FIG. 2 will be now briefly described. Similarly to that stated with reference to the first embodiment form, the solvent is taken by the pump 5 from the related tank 4, and delivered to dry-cleaning drum 1, wherefrom it flows then back to tank 4 through the filter 3.

The gases (i.e. a mixture of air and solvent vapor) that are evolved within the drum 1, are delivered through the pipe **16*a*, not fitted with any valve but equipped with the heater 16, to condenser 13, and then to filter 9, wherein a part of the solvent is separated by gravity, and is collected on the bottom thereof, while the remainder is adsorbed on the activated charcoal 11; the thus purified air is discharged to the outside through the duct 10**, thereby preventing a build-up of pressure inside of the plant.

At the end of the dry-cleaning step, the processed clothing is dried; the air-solvent vapor mixture, coming from the drum 1 is directly delivered by the fan 15 to condenser 13, where the recovery of solvent is performed; the condensate is collected within the separator 14, wherefrom it flows back to related tank 4.

The air that flows out of the condenser 13 is heated in the heater 16, and then is fed to drum 1 for starting the next dry-cleaning cycle. Even in the latter case, in the course of the drying step, the slight vacuum which is caused by the condensation in the related circuit, causes the solvent collected on the bottom of filter 9 in the course of the preceding dry-cleaning step, to flow to condenser 13, being thus recovered; moreover, due to the action of the air stream flowing from the duct 10, a part of the solvent present within the filter proper is also recovered.

The remainder of solvent left in the filter cartridge is recovered in the course of the out-of-service times of machine (usually overnight). As a matter of fact, since the cooling element of condenser 13 is kept always operated (as is used in such machines), a continuous sucking action is exerted on the solvent yet present in the filter 11, until it is wholly recovered within relatively short times, and at any rate within the out-of-service times of the machine.

Thus, by an extremely simple solution, and taking advantages of the typical, inherent features of the considered machines, the solvent can be recovered (partly in the first embodiment form, and wholly in the second embodiment form) from the vapors evolved in the course of dry-cleaning cycles, preventing at the same time any building-up of pressure or of vacuum of the machine, without the need of having recourse to complexmand expensive, specific accessory devices. With solvents or solvent mixtures having boiling points higher than the ambient temperature, it will be sufficient to have a heating element placed inside of filter 9, to promote the recovery of solvent, as previously stated.

Obviously, many modifications and variations of the present invention are possible in the light of the above teachings. Therefore, it is to be understood that the invention is not limited in its application to the specifically described or illustrated details, and that within the scope of the appended claims, it may be practised otherwise than as specifically described or illustrated.

What I claim is:

1. In dry-cleaning machines and/or plants including a cleaning circuit comprising a cleaning drum, a solvent tank, a solvent circulating pump and a filter for the solvent, all connected in series, and a drying and solvent recovery circuit comprising said drum, a circulating fan and a condenser connected in series, the vapor outlet of said condenser being connected through a heater to said drum and the liquid outlet of said condenser being connected through a separator to said tank, the improvement whereby solvent vapors evolved in the course of a cleaning cycle in such machines and/or plants are recovered and such machines and/or plants are depressurized, consisting essentially of:

a solvent recovery filter, located at a level higher than the remainder of the machine and/or plant, said filter having an inlet directly connected with the highest point of said drying circuit, and an outlet leading directly to the atmosphere.

2. An apparatus according to claim 1, wherein the inlet of said solvent recovery filter is connected with said dry-cleaning drum.

3. An apparatus according to claim 1, wherein said condenser is always connected with the dry-cleaning drum, and wherein the inlet of said solvent recovery filter is directly connected with said condenser.

4. An apparatus according to claim 3, wherein said solvent recovery filter is subdivided into two chambers, including a free bottom chamber and an upper chamber in which a filter cartridge is fitted.

5. A circuit according to claim 4, wherein said filter cartridge is filled with activated charcoal.

* * * * *